US008206878B2

(12) United States Patent
Ueno et al.

(10) Patent No.: US 8,206,878 B2
(45) Date of Patent: Jun. 26, 2012

(54) LIQUID DEVELOPER AND IMAGE FORMING APPARATUS

(75) Inventors: Yoshihiro Ueno, Shiojiri (JP); Masahiro Oki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 360 days.

(21) Appl. No.: 12/502,043

(22) Filed: Jul. 13, 2009

(65) Prior Publication Data

US 2010/0014894 A1 Jan. 21, 2010

(30) Foreign Application Priority Data

Jul. 15, 2008 (JP) ..... 2008-183559

(51) Int. Cl.
*G03G 13/01* (2006.01)

(52) U.S. Cl. ..... 430/45.2; 430/109.1; 430/137.2

(58) Field of Classification Search ..... 430/45.2, 430/109.1, 137.2
See application file for complete search history.

(56) References Cited

U.S. PATENT DOCUMENTS

| | | | | |
|---|---|---|---|---|
| 5,700,395 | A * | 12/1997 | Thetford et al. | 516/31 |
| 6,165,258 | A * | 12/2000 | Asada | 106/31.26 |
| 6,627,709 | B2 * | 9/2003 | Endo | 526/89 |
| 2007/0141504 | A1 * | 6/2007 | Miyakawa | 430/115 |

FOREIGN PATENT DOCUMENTS

| | | |
|---|---|---|
| JP | 3332961 | 10/2002 |

* cited by examiner

*Primary Examiner* — Thorl Chea
(74) *Attorney, Agent, or Firm* — DLA Piper LLP

(57) ABSTRACT

A liquid developer includes an insulating liquid and toner particles obtained by surface-modifying toner mother particles made of a material containing a rosin resin with a polyalkyleneimine.

7 Claims, 2 Drawing Sheets

LIQUID DEVELOPER AND IMAGE FORMING APPARATUS

CROSS-REFERENCE TO RELATED APPLICATIONS

This application claims the benefit of priority under 35 USC 119 of Japanese application no. 2008-183559, filed on Jul. 15, 2008, which is incorporated herein by reference.

BACKGROUND

1. Technical Field

The present invention relates to a liquid developer and an image forming apparatus.

2. Related Art

As a developer to be used for developing an electrostatic latent image formed on a latent image carrying member, a liquid developer obtained by dispersing a toner made of a material containing a colorant such as a pigment and a binder resin in an electrically insulating carrier liquid (insulating liquid) is known.

In toner particles constituting such a liquid developer, a resin material such as a polyester resin, a styrene-acrylic ester copolymer or an epoxy resin has been used. Such a resin material has characteristics that it is easy to handle, a color developing property of the resulting image is good and a high fixing property can be obtained.

However, in a past liquid developer, a resin material constituting the toner particles and an insulating liquid had a low affinity for each other, and it was difficult to make the dispersibility of the toner particles in the insulating liquid sufficiently high.

In order to improve the dispersibility of such toner particles, an attempt to use a rosin resin with a high affinity for an insulating liquid as the resin material constituting the toner particles has been made (see, for example, Japanese Patent No. 3332961).

However, in the liquid developer described in Japanese Patent No. 3332961, although the initial dispersibility of the toner particles was good, the toner particles aggregated over time and it was difficult to maintain the dispersibility for a long period of time. Further, in the past liquid developer, sufficient chargeability could not be obtained, and in particular it was difficult to obtain positive chargeability.

SUMMARY

The present invention advantageously provides a liquid developer excellent in positive chargeability and long-term dispersion stability of toner particles, and an image forming apparatus using such a liquid developer. Some aspects of the invention are described below.

A liquid developer according to a first aspect of the invention includes:

an insulating liquid; and toner particles obtained by surface-modifying toner mother particles made of a material containing a rosin resin with a polyalkyleneimine.

In the liquid developer according to the first aspect of the invention, the polyalkyleneimine preferably has a number average molecular weight of from 5000 to 100000.

In the liquid developer according to the first aspect of the invention, the polyalkyleneimine is preferably polyethyleneimine.

In the liquid developer according to the first aspect of the invention, the toner particles preferably further include a resin material having an ester bond other than the rosin resin.

In the liquid developer according to the first aspect of the invention, the rosin resin preferably has a softening point of from 80 to 190° C.

In the liquid developer according to the first aspect of the invention, the rosin resin preferably has a weight average molecular weight of from 500 to 100000.

In the liquid developer according to the first aspect of the invention, the insulating liquid preferably mainly contains a vegetable oil.

An image forming apparatus according to a second aspect of the invention includes:

plural developing parts configured to form plural monochrome images corresponding to plural liquid developers of different colors using the plural liquid developers;

an intermediate transfer part configured such that the plural monochrome images formed in the plural developing parts are sequentially transferred thereon to form an intermediate transfer image by superimposing the transferred plural monochrome images;

a secondary transfer part configured to transfer the intermediate transfer image to a recording medium to form an unfixed color image on the recording medium; and a fixing part configured to fix the unfixed color image on the recording medium, wherein the liquid developers each contain:

an insulating liquid; and toner particles obtained by surface-modifying toner mother particles made of a material containing a rosin resin with a polyalkyleneimine.

According to the above configuration, a liquid developer excellent in positive chargeability and long-term dispersion stability of toner particles is provided. Further, an image forming apparatus using such a liquid developer is provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
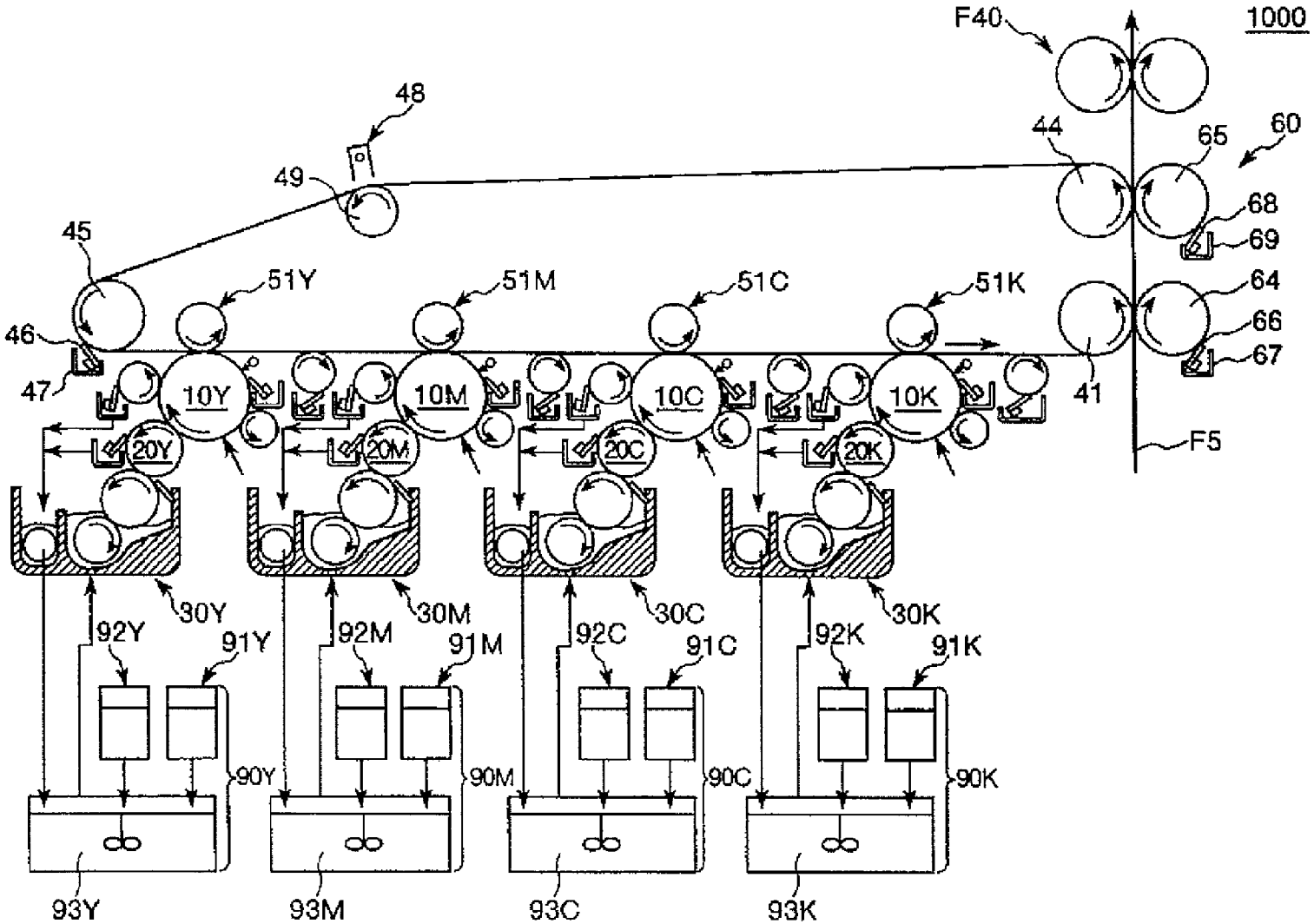
FIG. 1 is a schematic view showing an example of an image forming apparatus to which a liquid developer according to an embodiment of the invention is applied.

Hereinafter, embodiments of the invention will be described in detail.

Liquid Developer

First, the liquid developer of the invention will be described.

The liquid developer of the invention includes an insulating liquid and toner particles obtained by modifying the surfaces of toner mother particles made of a material containing a rosin resin with a polyalkyleneimine.

Hereinafter, each component will be described in detail.

Toner Particles

The toner particles are obtained by modifying the surfaces of toner mother particles made of a material containing a rosin resin with a polyalkyleneimine.

Toner Mother Particles

The toner mother particles include at least a binder resin (resin material) and a colorant.

1. Resin Material (Binder Resin)

The toner mother particles are made of a material containing a resin material as a major component.

In the invention, the toner mother particles contain a rosin resin as the resin material.

The rosin resin is a material that is advantageous in making the fixing property of a toner to a recording medium excellent and is easily and surely modified (chemically modified) with a polyalkyleneimine. In other words, the rosin resin is a material having a large number of functional groups (acidic groups) with high reactivity to a polyalkyleneimine described below. Therefore, when the rosin resin is once modified with a polyalkyleneimine, the polyalkyleneimine and the rosin resin are chemically bound to each other, and thus, detachment or release of the polyalkyleneimine from the modified rosin resin is less likely. That is, in the liquid developer of the invention, the polyalkyleneimine is rigidly attached to the rosin resin constituting the toner mother particles. Accordingly, while making the fixing property of the toner particles excellent, the dispersibility and dispersion stability (long-term dispersion stability) of the toner particles in the insulating liquid and the positive chargeability of the toner particles can be made excellent.

The rosin resin may exist on at least a part of the surface of the toner mother particle, may be contained in the entire of the toner mother particle, or may be localized on the surface of the toner mother particle. Further, the rosin resin may cover the surface of the toner mother particle.

Examples of the rosin resin include rosin-modified phenol resins, rosin-modified maleic resins, rosin-modified polyester resins, fumaric-modified rosin resins and ester gums. These can be used alone or in combinations of two or more.

A softening point of the rosin resin is preferably from 60-190° C., more preferably from 65-170° C., and further more preferably from 70-160° C. According to this, while making the long-term dispersion stability and the chargeability of the toner particles excellent, both the fixing property and heat resistant storage stability of the toner particles can be achieved at a higher level.

A weight average molecular weight of the rosin resin is preferably from 500-100000, more preferably from 1000-80000, and further more preferably from 1000-50000. According to this, while making the long-term dispersion stability and the chargeability of the toner particles excellent, both the fixing property and heat resistant storage stability of the toner particles can be achieved at a higher level.

An acid value of the rosin resin is preferably 40 mg KOH/g or less, more preferably 30 mg KOH/g or less, and further more preferably 5 to 25 mg KOH/g or less. According to this, chemical modification of the surfaces of the toner mother particles with polyethyleneimine can be more preferably performed, and while making the long-term dispersion stability and the chargeability of the toner particles particularly excellent, both the fixing property and heat resistant storage stability of the toner particles can be achieved at a higher level.

A content of the rosin resin in the resin material constituting the toner mother particles is preferably from 1-50 wt %, and more preferably from 5-40 wt %. According to this, while making the long-term dispersion stability and the chargeability of the toner particles particularly excellent, both the fixing property and heat resistant storage stability of the toner particles can be achieved at a higher level.

The toner mother particles may contain a resin other than a rosin resin as described above. In particular, a rosin resin as described above and a resin material having an ester bond are preferably used in combination. A resin material having such a bond has low compatibility with the rosin resin, and therefore can allow the rosin resin to more surely exist on the surfaces of the toner particles. As a result, the surfaces of the toner mother particles can be chemically modified with a larger amount of the polyalkyleneimine and the positive chargeability of the toner particles can be made higher, and also the dispersion stability of the toner particles can be made higher. Further, the high-temperature storage stability of the liquid developer can be made higher.

Examples of a resin material having an ester bond include polyester resins, styrene-acrylic ester copolymers and methacrylic resins. Among these, a polyester resin is preferably used. A polyester resin has a high transparency, and when it is used as a binder resin, a color developing property of the resulting image can be made high. Further, a polyester resin has a particularly low compatibility with the rosin resin and therefore is more surely phase-separated from the rosin resin in the toner mother particles and can allow the rosin resin to more effectively exist on the surfaces of the toner particles.

When the toner mother particles contain a polyester resin, an acid value thereof is preferably from 5-20 mg KOH/g, and is more preferably from 5-15 mg KOH/g.

When the toner mother particles contain a polyester resin, a softening point thereof is not particularly limited, however, it is preferably from 50-130° C., more preferably from 50-120° C., and further more preferably from 60-115° C. According to this, the fixing property of the toner particles can be made particularly excellent. The softening point as used herein refers to a softening initiation temperature defined by using a koka-type flow tester (such as one manufactured by Shimadzu Corporation) under the following measurement conditions: temperature increasing rate: 5° C./min; and die diameter: 1.0 mm.

2. Colorant

The toner mother particles may also contain a colorant. The colorant is not particularly limited, and for example, a known pigment, dye or the like can be used.

3. Other Components

The toner mother particles may also contain components other than the above components. Examples of such components include known waxes and magnetic powder.

As a constituent material (component) of the toner mother particles other than the above-mentioned components, for example, zinc stearate, zinc oxide, cerium oxide, silica, titanium oxide, iron oxide, a fatty acid, a fatty acid metal salt or the like may be used.

Polyalkyleneimine

As described above, toner mother particles made of a material containing a rosin resin are surface-modified with a polyalkyleneimine. Surface modification with a polyalkyleneimine means that at least a part of amino groups of the polyalkyleneimine and at least a part of acidic groups (mainly carboxyl groups) derived from the rosin resin on the surfaces of the toner mother particles are chemically reacted with each other to form a covalent bond (amide bond) or an acidic group of the rosin resin and an amino group of the polyalkyleneimine form an ionic bond.

The polyalkyleneimine has a large number of amino groups and therefore is a compound with high positive chargeability.

In order to improve the dispersibility of toner particles in an insulating liquid, an attempt to use a rosin resin with a high affinity for the insulating liquid as the resin material constituting the toner particles has been made. However, in the past liquid developer, although the initial dispersibility of the toner particles was good, the toner particles aggregated over time and it was difficult to maintain the dispersibility for a long period of time.

Further, a rosin resin as described above generally has negative chargeability. When such a resin material with negative chargeability was used, it was difficult to positively charge the toner particles (liquid developer). It was conceivable that the toner particles were positively charged by adding a charge control agent to toner particles using such a resin material with negative chargeability, however, it was difficult to obtain a sufficient charge amount. Further, it was conceivable that a resin material with positive chargeability was used as a constituent material of the toner particles. However, the resin material with positive chargeability had low stability itself and it was difficult to apply such a resin material as the material constituting toner particles. Further, it was conceivable that all toner particles were positively charged by using a charge control agent or a dispersant with positive chargeability. However, in this case, although the initial dispersibility of the toner particles was good, the charge control agent or dispersant was detached or released from the toner particles (toner mother particles) over time and it was difficult to maintain stable positive chargeability for a long period of time. In particular, in an image forming apparatus having a mechanism of reusing a liquid developer recovered in a developing part or the like as described below, stress was applied to the toner particles when the liquid developer was recovered. Therefore, in the case of a toner using only a charge control agent or a dispersant with positive chargeability, the charge control agent or dispersant was detached or released from the toner particles (toner mother particles) and the chargeability of the toner particles was liable to rapidly decrease. Further, when toner particles were tried to be sufficiently positively charged by using a charge control agent with positive chargeability, due to the effect of the charge control agent, the color of the toner particles were adversely affected in some cases.

In view of the above problems, the present inventors made intensive studies, and as a result, they found that by modifying the surfaces of toner mother particles made of a material containing a rosin resin with a polyalkyleneimine, a liquid developer in which toner particles are excellent in positive chargeability and can be stably dispersed in an insulating liquid for a long period of time is provided. That is, a liquid developer excellent in positive chargeability and also long-term dispersion stability of toner particles is provided. Further, since the liquid developer is excellent in chargeability and long-term dispersion stability, it is also excellent in properties such as developing efficiency and transferring efficiency.

That is, in the invention, by modifying (chemically modifying) the surfaces of toner mother particles made of a material containing a rosin resin with a polyalkyleneimine with positive chargeability, while allowing the characteristics of the rosin resin to be sufficiently exhibited, the problems described above are surely prevented and the long-term dispersion stability of toner particles in the liquid developer and the positive chargeability thereof can be made sufficiently excellent. Further, in an image forming apparatus as described below, when the liquid developer recovered in a developing part and the like is reused, the toner particles in the recovered liquid developer can be easily redispersed and reused.

Further, the polyalkyleneimine has a high affinity for an insulating liquid as described below, and by chemically modifying the surfaces of the toner mother particles with the polyalkyleneimine, the dispersion stability of the toner particles can be made particularly excellent.

Incidentally, the excellent effect as described above is obtained by modifying the surfaces of the toner mother particles with the polyalkyleneimine and is not obtained only by incorporating the polyalkyleneimine in the liquid developer.

Examples of the polyalkyleneimine include polyethyleneimine, polypropyleneimine, polybutyleneimine and polyisopropyleneimine. Among these, polyethyleneimine is preferably used. By using this, the surfaces of the toner mother particles can be more preferably chemically modified, and the long-term dispersion stability and the positive chargeability of the toner particles can be made more excellent.

A number average molecular weight of the polyalkyleneimine is preferably from 300-200000, and more preferably from 10000-80000. When the number average molecular weight of the polyalkyleneimine falls within this range, the surfaces of the toner mother particles can be more effectively modified (chemically modified), and due to the steric hindrance of a relatively long molecular chain of the polyalkyleneimine, aggregation of the toner particles can be effectively prevented. Accordingly, the dispersion stability of the toner particles can be effectively improved.

Shape of Toner Particles

An average particle diameter of the toner particles made of the material as described above is preferably from 0.5-3 μm, more preferably from 1-2.5 μm, and further more preferably from 1-2 μm. When the average particle diameter of the toner particles falls within this range, a variation in properties among the toner particles can be made small, whereby the resolution of a toner image formed with the liquid developer can be made sufficiently high while making the reliability of the liquid developer as a whole high. Further, the dispersion of the toner particles in the insulating liquid can be made favorable and the storage stability of the liquid developer can be made high. The term "average particle diameter" as used herein refers to an average particle diameter by volume.

A content of the toner particles in the liquid developer is preferably from 10-60 wt %, and more preferably from 20-50 wt %.

Insulating Liquid

The insulating liquid is now described.

The insulating liquid may be any liquid having a sufficiently high insulating property. Specifically, the insulating liquid has an electric resistance at room temperature (20° C.) of preferably $1\times10^{9}$ Ωcm or more, more preferably $1\times10^{11}$ Ωcm or more, and further more preferably $1\times10^{13}$ Ωcm or more.

Further, a relative dielectric constant of the insulating liquid is preferably 3.5 or less.

Examples of an insulating liquid that satisfies the above-mentioned conditions include mineral oils (hydrocarbon liquids) such as Isopar E, Isopar G, Isopar H and Isopar L ("Isopar" is the trade name of Exxon Chemical Company) Shellsol 70 and Shellsol 71 ("Shellsol" is the trade name of Shell Oil Company), Amsco OMS and Amsco 460 solvents ("Amsco" is the trade name of Spirits Co.) and low-viscosity/high-viscosity liquid paraffins (wako Pure Chemical Industries, Ltd.), fatty acid glycerides, fatty acid esters such as fatty acid monoesters and medium-chain fatty acid esters, and vegetable oils including the same, octane, isooctane, decane, isodecane, decalin, nonane, dodecane, isododecane, cyclohexane, cyclooctane, cyclodecane, benzene, toluene, xylene and mesitylene. These can be used alone or in combinations of two or more. Among these, especially, vegetable oils and fatty acid monoesters have a particularly high affinity for (compatibility with) rosin resin and therefore can further improve the dispersion stability of the toner particles.

The liquid developer (insulating liquid) may further contain a known antioxidant, a charge control agent or the like other than the above-mentioned components.

A viscosity of the insulating liquid is not particularly limited, however, it is preferably from 5-1000 mPa·s, more preferably from 50-800 mPa·s, and further more preferably from 50-500 mPa·s. Where the viscosity of the insulating liquid falls within this range, when the liquid developer is drawn out of a developer vessel by a coating roller, an adequate amount of the insulating liquid is adhered to the toner particles, and the developing property and the transferring property of a toner image can be made particularly excellent. Further, the dispersibility of the toner particles can be made higher and also in an image forming apparatus as described below, the liquid developer can be more uniformly supplied to the coating roller and also dripping or the like of the liquid developer from the coating roller or the like can be effectively prevented. In addition, aggregation or precipitation of the toner particles can be more effectively prevented and the dispersibility of the toner particles in the insulating liquid can be made higher. On the other hand, when the viscosity of the insulating liquid is less than the lower limit of the above-mentioned ranges, in an image forming apparatus as described below, a problem such as dripping of the liquid developer from the coating roller or the like may arise. Meanwhile, when the viscosity of the insulating liquid exceeds the upper limit of the above-mentioned ranges, the dispersibility of the toner particles cannot be made sufficiently high, and in an image forming apparatus as described below, the liquid developer cannot be more uniformly supplied to the coating roller in some cases. In this connection, the term "viscosity" as used herein refers to a value obtained by measurement at 25° C.

The liquid developer of the invention may further contain a component (such as an external additive) other than the above-mentioned components.

Process for Producing Liquid Developer

An embodiment of a process for producing the liquid developer according to the invention is now described.

The process for producing the liquid developer according to this embodiment includes a dispersion liquid providing step of providing a dispersion liquid in which toner mother particles containing a rosin resin are dispersed in an aqueous dispersion medium; a chemically modifying step of mixing a polyalkyleneimine with the dispersion liquid and modifying the surfaces of the toner mother particles with the polyalkyleneimine to obtain toner particles; and an insulating liquid dispersing step of dispersing the toner particles in an insulating liquid.

The steps constituting the process for producing the liquid developer are now described in detail.

Dispersion Liquid Providing Step (Aqueous Dispersion Liquid Providing Step)

First, a dispersion liquid (aqueous dispersion liquid) in which toner mother particles containing a rosin resin are dispersed in an aqueous dispersion medium is prepared.

The aqueous dispersion liquid may be prepared by any method, however, it is preferably prepared as a suspension liquid through a resin solution preparing step of preparing a resin solution in which a constituent material (a mother particle material) of toner mother particles including a rosin resin and the like is dissolved in an organic solvent; an O/W emulsion liquid preparing step of preparing an O/W emulsion liquid via a W/O emulsion liquid by adding an aqueous liquid to the resin solution; a coalescing step of coalescing dispersoids contained in the O/W emulsion liquid to obtain coalescent particles; and an organic solvent removing step of removing the organic solvent contained in the coalescent particles to form the toner mother particles. In this manner, the uniformity of the size and shape of the dispersoids contained in the aqueous dispersion liquid can be made particularly high, the particle size distribution of the toner particles contained in the finally obtained liquid developer can be made extremely sharp and the variation in properties among the toner particles can be made particularly small. In the following description, a case in which the aqueous dispersion liquid is prepared through the resin solution preparing step, the O/W emulsion liquid preparing step, the coalescing step and the organic solvent removing step will be described as a representative example.

Resin Solution Preparing Step

First, a resin solution in which a rosin resin and the like are dissolved in an organic solvent is prepared.

The thus prepared resin solution contains a constituent material of toner mother particles as described above and an organic solvent as described below.

The organic solvent may be any as long as it can dissolve at least a portion of the resin material. However, an organic solvent having a boiling point lower than that of an aqueous liquid described below is preferably used. According to this, the organic solvent can be easily removed.

The organic solvent preferably has a low compatibility with an aqueous liquid (aqueous dispersion medium) described below (for example, an organic solvent having a solubility in 100 g of the aqueous liquid at 25° C. of 30 g or less). According to this, the dispersoids made of the mother particle material can be finely dispersed in an O/W emulsion liquid (aqueous emulsion liquid) described below in a stable state.

The composition of the organic solvent can be appropriately selected depending on, for example, the resin material as described above, the composition of the colorant, the composition of the aqueous liquid (aqueous dispersion medium) or the like.

Such an organic solvent is not particularly limited, however, examples thereof include ketone solvents such as MEK and aromatic hydrocarbon solvents such as toluene.

The resin solution can be obtained by mixing, for example, a resin material, a colorant, an organic solvent and the like using a stirrer or the like. Examples of a stirrer that can be used in the preparation of the resin solution include high-speed stirrers such as DESPA (manufactured by Asada Iron Works Co., Ltd.) and T.K. Robomix/T.K. Homo Disper Model 2.5 (manufactured by Primix Corporation).

A temperature of the material during stirring is preferably from 20-60° C., and more preferably from 30-50° C.

A solid content in the resin solution is not particularly limited, however, it is preferably from 40-75wt %, more preferably from 50-73 wt %, and further more preferably from 50-70wt %. When the solid content falls with in this range, the sphericity of the dispersoids constituting a dispersion liquid (aqueous dispersion liquid) described below can be made higher (a shape close to a sphere), and the shape of the finally obtained toner particles can be more surely made favorable.

In the preparation of the resin solution, all constituent components of the resin solution to be prepared may be mixed simultaneously, or a part of the constituent components of the resin solution to be prepared is mixed to obtain a mixture (master mix) and thereafter, the mixture (master mix) may be mixed with the other components.

O/W Emulsion Liquid Preparing Step

Subsequently, an O/W emulsion liquid is prepared via a W/O emulsion liquid by adding an aqueous liquid to the resin solution.

As the aqueous liquid, an aqueous liquid mainly containing water can be used.

The aqueous liquid may contain, for example, a solvent excellent in compatibility with water (for example, a solvent having a solubility in 100 parts by weight of water at 25° C. of 50 parts by weight or more).

An emulsifying dispersant may be added as needed to the aqueous liquid. By adding an emulsifying dispersant thereto, the aqueous emulsion liquid can be more easily prepared. The emulsifying dispersant is not particularly limited, and for example, a known emulsifying dispersant can be used.

When the O/W emulsion liquid is prepared, for example, a basic substance may be used. By using a basic substance, a functional group (such as a carboxyl group) of the resin material can be neutralized, and the uniformity of the shape and size of the dispersoids in the O/W emulsion liquid to be prepared, and the dispersibility of the dispersoids can be made particularly excellent. Consequently, the resulting toner particles have a particularly sharp particle size distribution. The basic substance may be added, for example, to the resin solution or the aqueous liquid. Further, in the preparation of the O/W emulsion liquid, the basic substance may be added plural times in divided portions.

Examples of the basic substance include sodium hydroxide, potassium hydroxide and ammonia, and one kind or a combination of two or more kinds selected from these compounds can be used.

A used amount of the basic substance is preferably an amount corresponding to 1-3 times (1-3 equivalents), and more preferably an amount corresponding to 1-2 times (1-2 equivalents) the amount necessary for neutralizing all the carboxyl groups of the resin material. According to this, the formation of irregularly shaped dispersoids can be effectively prevented, and further, the particle size distribution of particles obtained in the coalescing step described in detail below can be made sharper.

The addition of the aqueous liquid to the resin solution may be performed by any method, however, the aqueous liquid containing water is preferably added to the resin solution while stirring the resin solution. That is, the aqueous liquid is preferably gradually added (dropwise) to the resin solution while applying a shearing force to the resin solution using a stirrer or the like to cause phase conversion from a W/O-type emulsion liquid (W/O emulsion liquid) into an O/W-type emulsion liquid (O/W emulsion liquid). In this manner, the uniformity of the size and shape of the dispersoids contained in the O/W emulsion liquid can be made particularly high, the particle size distribution of the toner particles contained in the finally obtained liquid developer can be made extremely sharp and the variation in properties among the toner particles can be made particularly small.

Examples of a stirrer that can be used in the preparation of the O/W emulsion liquid include high-speed stirrers and high-speed dispersers such as DESPA (manufactured by Asada iron Works Co., Ltd.), T.K. Robomix/T.K. Homo Disper Model 2.5 (manufactured by Primix Corporation), Slasher (manufactured by Mitsui Mining Co., Ltd.) and Cavitron (manufactured by Eurotec, Ltd.).

During the addition of the aqueous liquid to the resin solution, stirring is preferably performed such that a blade tip speed falls within a range from 10-20 m/sec,and more preferably from 12-18 m/sec. When the blade tip speed falls within this range, the O/W emulsion liquid can be efficiently obtained and also variation in shape and size of the dispersoids in the O/W emulsion liquid can be made particularly small, and uniform dispersibility of the dispersoids can be made particularly excellent while preventing the generation of too small dispersoids and coarse particles.

A solid content in the O/W emulsion liquid is not particularly limited, however, it is preferably from 5-55 wt %, and more preferably from 10-50 wt %. According to this, the productivity of the liquid developer can be made particularly excellent while more surely preventing unwanted aggregation of the dispersoids in the O/W emulsion liquid.

A temperature of the material in this treatment is preferably from 20-60° C., and more preferably from 20-50° C.

Coalescing Step

Subsequently, coalescent particles are obtained by coalescing plural dispersoids. The coalescence of the dispersoids usually proceeds by colliding the dispersoids containing an organic solvent and combining them with one another.

The coalescence of plural dispersoids is performed by adding an electrolyte to the O/W emulsion liquid while stirring the O/W emulsion liquid. In this manner, coalescent particles can be easily and surely obtained. Further, by controlling an addition amount of the electrolyte, the particle diameter and particle size distribution of the coalescent particles can be easily and surely controlled.

The electrolyte is not particularly limited and known organic and inorganic water-soluble salts and the like can be used alone or in combinations of two or more.

The electrolyte is preferably a monovalent cationic salt. By using this, the particle size distribution of the resulting coalescent particles can be made particularly sharp. In addition, by using a monovalent cationic salt, the generation of coarse particles can be surely prevented in this step.

Among the above-mentioned substances, the electrolyte is preferably a sulfate (such as sodium sulfate or ammonium sulfate) or a carbonate, and is particularly preferably a sulfate According to this, the particle diameter of the coalescent particles can be particularly easily controlled.

An amount of the electrolyte to be added in this step is preferably from 0.5-3 parts by weight, and more preferably from 1-2 parts by weight based on 100 parts by weight of the solid content in the O/W emulsion liquid to which the electrolyte is added. According to this, the particles diameter of the coalescent particles can be particularly easily and surely controlled, and also the generation of coarse particles can be surely prevented.

The electrolyte is preferably added in a state of an aqueous solution. According to this, the electrolyte can be promptly diffused throughout the entire O/W emulsion liquid and also an addition amount of the electrolyte can be easily and surely controlled. As a result, the coalescent particles having a desired particle diameter and a very sharp particle size distribution can be obtained.

When the electrolyte is added in a state of an aqueous solution, a concentration of the electrolyte in the aqueous solution is preferably from 2-10 wt %, and more preferably from 2.5-6 wt %. According to this, the electrolyte can be particularly promptly diffused throughout the entire O/W emulsion liquid and also an addition amount of the electrolyte can be easily and surely controlled. Further, by adding such an aqueous solution, a content of water in the O/W emulsion liquid after completion of addition of the electrolyte is made favorable. Accordingly, a growing rate of the coalescent particles after addition of the electrolyte can be made adequately slow to such an extent that the productivity is not decreased.

As a result, the particle diameter thereof can be more surely controlled. In addition, unwanted coalescence of the coalescent particles can be surely prevented.

When the electrolyte is added in a state of an aqueous solution, an addition rate of the aqueous electrolyte solution is preferably from 0.5-10 parts by weight/min, and more preferably from 1.5-5 parts by weight/min based on 100 parts by weight of the solid content in the O/W emulsion liquid to which the aqueous electrolyte solution is added. According to this, an uneven concentration of the electrolyte in the O/W emulsion liquid can be prevented from being caused, and coarse particles can be surely prevented from being generated. In addition, the particle size distribution of the coalescent particles becomes further sharper. Moreover, by adding the electrolyte at such a rate, the coalescence rate can be particularly easily controlled, and controlling of the average particle diameter of the coalescent particles becomes particularly easy, and also the productivity of the liquid developer can be made particularly excellent.

The electrolyte may be added plural times in divided portions. By doing this, the coalescent particles having a desired size can be easily and surely obtained, and also the degree of circularity of the resulting coalescent particles can be surely made sufficiently high.

This step is performed while stirring the O/W emulsion liquid. By doing this, coalescent particles having a particularly small variation in shape and size among the particles can be obtained.

For stirring the O/W emulsion liquid, a stirring blade such as an anchor blade, a turbine blade, a pfaudler blade, a fullzone blade, a max blend blade or a crescentic blade can be used, and in particular, a max blend blade or a fullzone blade is preferred. According to this, the added electrolyte can be promptly and uniformly dispersed or dissolved, and an uneven concentration of the electrolyte can be surely prevented from being caused. Further, while efficiently coalescing the dispersoids, once formed coalescent particles can be more surely prevented from disintegrating. As a result, the coalescent particles having a small variation in shape and particle diameter among the particles can be efficiently obtained.

A blade tip speed of the stirring blade is preferably from 0.1-10 m/sec, more preferably from 0.2-8 m/sec, and further more preferably from 0.2-6 m/sec. When the blade tip speed falls within this range, the added electrolyte can be uniformly dispersed or dissolved, and an uneven concentration of the electrolyte can be surely prevented from being caused. Further, while more efficiently coalescing the dispersoids, once formed coalescent particles can be more surely prevented from disintegrating.

An average particle diameter of the resulting coalescent particles is preferably from 0.5-5 μm, and more preferably from 1.5-3 μm. According to this, the particle diameter of the finally obtained toner particles can more surely be made adequate.

Organic Solvent Removing Step

Thereafter, the organic solvent contained in the O/W emulsion liquid (particularly in the dispersoids) is removed. In this manner, a dispersion liquid (aqueous dispersion liquid) in which the toner mother particles are dispersed in an aqueous dispersion medium can be obtained.

The removal of the organic solvent may be performed by any method. It can be performed, for example, under reduced pressure. In this manner, the organic solvent can be efficiently removed while sufficiently preventing the degeneration, etc. of the constituent material such as the resin material.

A treatment temperature in this step is preferably lower than the glass transition point (Tg) of the resin material constituting the coalescent particles.

This step may be performed in a state where an antifoaming agent is added to the O/W emulsion liquid (dispersion liquid). In this manner, the organic solvent can be efficiently removed.

As the antifoaming agent, for example, a lower alcohol, a higher alcohol, an oil or fat, a fatty acid, a fatty acid ester, a phosphoric acid ester or the like as well as a mineral oil antifoaming agent, a polyether antifoaming agent, or a silicone antifoaming agent can be used.

A used amount of the antifoaming agent is not particularly limited, however, it is preferably from 20-300 ppm by weight, and more preferably from 30-100 ppm by weight based on the solid content in the O/W emulsion liquid.

In this step, at least a portion of the aqueous liquid may be removed along with the organic solvent.

Further, in this step, it is not necessary that all the organic solvent (the total amount of the organic solvent contained in the dispersion liquid) be removed. Even if all the organic solvent is not removed, the remaining organic solvent can be sufficiently removed in a step described below.

Washing Step (First washing step)

Subsequently, the thus obtained toner mother particles are washed. By doing this, a dispersion liquid (aqueous dispersion liquid) containing washed toner mother particles can be obtained.

By performing this step, even if an organic solvent and the like are contained as impurities, these can be efficiently removed. Further, by performing this step, the electrolyte, basic substance or acidic substance used in the above-mentioned steps, or a salt generated by an acid-base reaction can be efficiently removed. As a result, the total volatile organic compound (TVOC) concentration in the finally obtained toner particles can be made particularly low. Further, the electric resistance of the insulating liquid can be made particularly high and also the stability of properties of the toner particles is improved.

This step can be performed by, for example, separating the toner mother particles through solid-liquid separation (separation from the aqueous liquid), and thereafter redispersing the solid matter (toner mother particles) in an aqueous liquid (aqueous dispersion medium) The solid-liquid separation and redispersion of the solid matter in water may be repeated more than once. Washing is preferably performed until the electrical conductivity of a supernatant of the dispersion liquid (slurry) obtained by redispersing the solid matter (toner mother particles) in the aqueous liquid (aqueous dispersion medium) becomes 20 μS/cm or less.

Surface Modifying Step

Subsequently, the surfaces of the toner mother particles as described above are modified with a polyalkyleneimine by mixing the dispersion liquid (aqueous dispersion liquid) containing the toner mother particles with the polyalkyleneimine.

This step may be performed in any condition as long as it is performed by mixing the aqueous dispersion liquid with a polyalkyleneimine. However, it is preferably performed in a condition where the hydrogen ion exponent (pH) of the dispersion liquid (aqueous dispersion liquid) is adjusted to 2-8. By doing this, while surely preventing unwanted degeneration, etc. of the constituent material of the toner mother particles, a reaction of an acidic group present on the surfaces of the toner mother particles made of the material containing the rosin resin with the polyalkyleneimine can be allowed to more efficiently proceed and the polyalkyleneimine can be rigidly attached to the surfaces of the toner mother particles.

As a result, the long-term dispersion stability of the toner particles and stability of the chargeability thereof can be made particularly excellent. As described above, the hydrogen ion exponent (pH) of the dispersion liquid (aqueous dispersion liquid) in this step is preferably from 2-8, more preferably from 2.5-6.5, and further more preferably from 4-5. According to this, the effect as described above is more remarkably exhibited.

The adjustment of pH of the dispersion liquid can be performed by adding, for example, 1 N hydrochloric acid or the like.

After the dispersion liquid and the polyalkyleneimine are mixed, the resulting mixed liquid is preferably stirred for about 1-3 hours. By doing this, the surfaces of the toner mother particles can be more uniformly modified (chemically modified).

The stirring may be performed at room temperature or while heating the mixed liquid to about 30-40° C. By stirring the mixed liquid while heating, the surfaces of the toner mother particles can be more efficiently modified (chemically modified).

A used amount of the polyalkyleneimine in this step is preferably from 0.1-10 parts by weight, more preferably from 0.3-6.0 parts by weight, and further more preferably from 0.5-3.0 parts by weight based on 100 parts by weight of the rosin resin. When the used amount of the polyalkyleneimine falls within this range, in the finally obtained liquid developer, the long-term dispersion stability and the positive chargeability of the toner particles can be made particularly excellent while surely preventing the occurrence of inconvenience such as elution of excess polyalkyleneimine to the insulating liquid.

Washing Step (Second Washing Step)

Subsequently, the thus obtained toner particles are washed.

By performing this step, even where an organic solvent and the like are contained as impurities, these can be efficiently removed. As a result, the total volatile organic compound (TVOC) concentration in the finally obtained toner particles can be made particularly low. Also, the stability of properties of the toner particles is improved.

As described above, the polyalkyleneimine is rigidly attached to the toner mother particles containing the rosin resin. Therefore, unlike a dispersant or the like to be used in a liquid developer in the past, even if a washing treatment is performed, detachment or release of the polyalkyleneimine from the toner mother particles is surely prevented.

This step can be performed by, for example, separating the toner particles through solid-liquid separation (separation from the aqueous liquid), and thereafter redispersing the solid matter (toner particles) in an aqueous liquid (aqueous dispersion medium) and then performing solid-liquid separation (separation of the toner particles from the aqueous liquid). The redispersion of the solid matter in water and solid-liquid separation may be repeated more than once.

Drying Step

Thereafter, by performing a drying treatment, toner particles can be obtained. By performing such a step, a water content in the toner particles can surely be made sufficiently low and the storage stability of the finally obtained liquid developer and the stability of properties thereof can be made particularly excellent.

The drying step can be performed using, for example, a vacuum dryer (such as Ribocone (manufactured by Okawara MFG. CO., LTD.) or Nauta (manufactured by Hosokawa Micron Corporation)), a fluidized bed dryer (manufactured by Okawara MFG. CO., LTD.) or the like. In the invention, toner particles have a configuration such that the surfaces of the toner mother particles made of the material containing the rosin resin are modified (chemically modified) with the polyalkyleneimine, and therefore, even if the drying step is performed, aggregation of the toner particles can be surely prevented.

Insulating Liquid Dispersing Step

Subsequently, the thus obtained toner particles are dispersed in the insulating liquid, whereby the liquid developer is obtained.

The dispersion of the toner particles in the insulating liquid may be performed using any method, and can be performed by, for example, mixing the insulating liquid with the toner particles using a bead mill, a ball mill or the like.

In this dispersion, a component other than the insulating liquid and the toner particles may be mixed.

The dispersion of the toner particles in the insulating liquid may be performed using the total amount of the insulating liquid constituting the finally obtained liquid developer or using a portion of the insulating liquid.

Where the toner particles are dispersed using a portion of the insulating liquid, after completion of the dispersion, the same liquid as used in the dispersion may be added as the insulating liquid, or a liquid different from the liquid used in the dispersion may be added as the insulating liquid. In the latter case, properties such as viscosity of the finally obtained liquid developer can be easily controlled.

When the liquid developer is produced by the process as described above, the toner particles contained in the liquid developer have characteristics that the surfaces of the toner mother particles made of the material containing the rosin resin are modified with the polyalkyleneimine and the variation in shape and properties among the toner particles is small.

Image Forming Apparatus

An embodiment of an image forming apparatus according to the invention is now described. The image forming apparatus according to the invention forms a color image on a recording medium using the liquid developer of the invention as described above.

Figure 2:
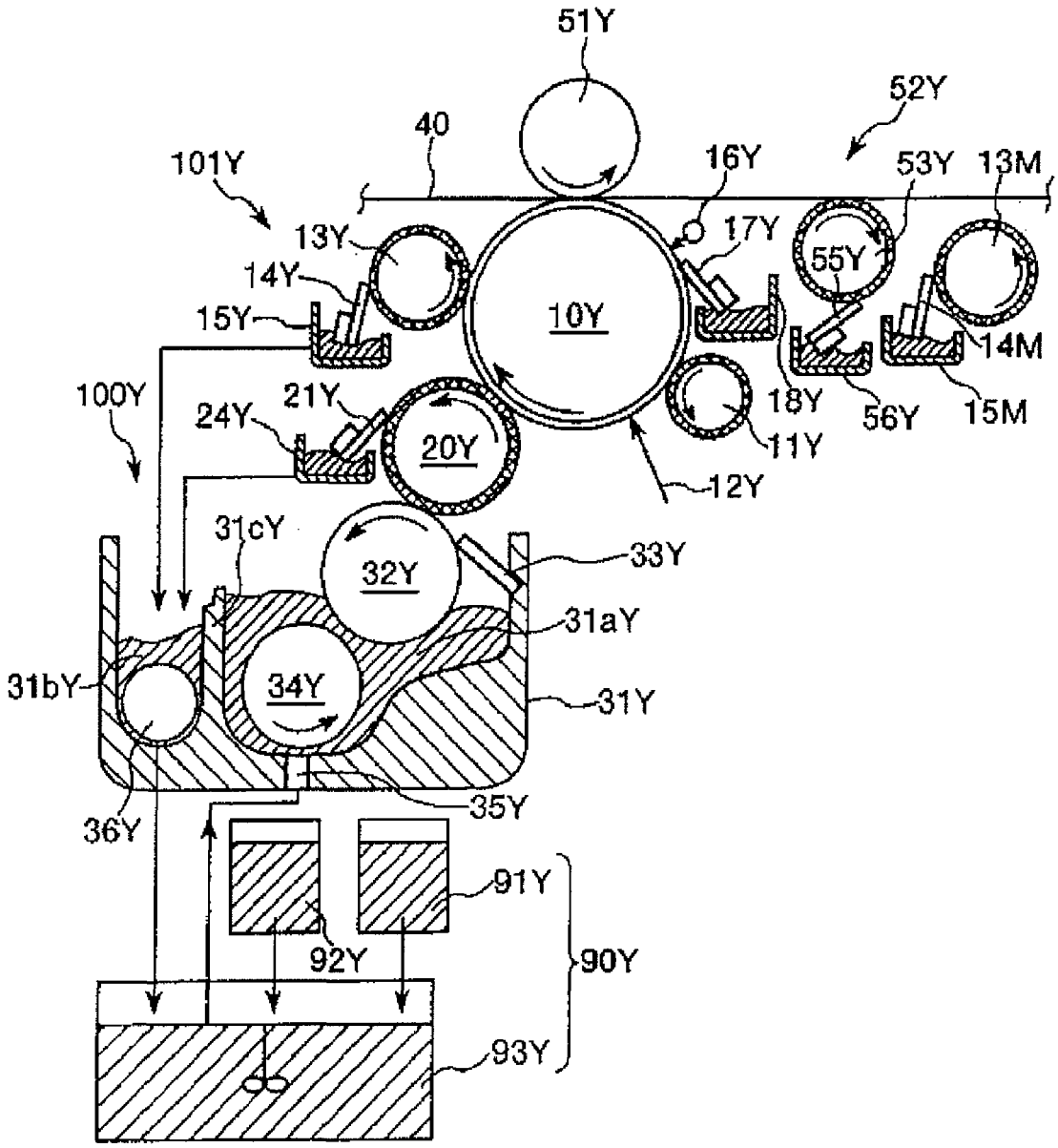
FIG. 2 is an enlarged view showing apart of the image forming apparatus of FIG. 1.

FIG. 1 is a schematic view showing an embodiment of an image forming apparatus to which the liquid developer of the invention is applied; and FIG. 2 is an enlarged view of a part of the image forming apparatus of FIG. 1.

As shown in FIGS. 1 and 2, an image forming apparatus 1000 has four developing parts 30Y, 30M, 30C and 30K, an intermediate transfer part 40, a secondary transfer unit (secondary transfer part) 60, a fixing part (fixing device) F40, and four liquid developer replenishing parts 90Y, 90M, 90C and 90K.

The developing parts 30Y, 30M and 30C have a function of developing latent images with a yellow liquid developer (Y), a magenta liquid developer (M) and a cyan liquid developer (C), respectively, to form monochrome images corresponding to the respective colors. The developing part 30K further has a function of developing a latent image with a black liquid developer (K) to form a black monochrome image.

The developing parts 30Y, 30M, 30C and 30K have the same constitution, and therefore, only developing part 30Y is described below.

As shown in FIG. 2, the developing part 30Y has a photoreceptor 10Y as an example of an image carrying member, and has, along the rotating direction of the photoreceptor 10Y, a charging roller 11Y, an exposure unit 12Y, a developing unit 100Y, a photoreceptor squeeze device 101Y, a primary transfer backup roller 51Y, a charge removal unit 16Y, a photoreceptor cleaning blade 17Y and a developer recovery part 18Y.

The photoreceptor 10Y has a tubular substrate and a photoreceptor layer that is formed on an outer peripheral surface of the tubular substrate and made of a material such as amorphous silicon, and is rotatable about the center axis thereof. In this embodiment, the photoreceptor 10Y rotates clockwise as shown by the arrow in FIG. 2.

The liquid developer is fed to the photoreceptor 10Y from the developing unit 100Y described below, and a layer of the liquid developer is formed on the surface thereof.

The charging roller 11Y is a device for charging the photoreceptor 10Y, and the exposure unit 12Y is a device for forming a latent image on the charged photoreceptor 10Y by irradiating laser light. The exposure unit 12Y has a semiconductor laser, a polygonal mirror, an F-θ lens and the like, and irradiates the charged photoreceptor 10Y with laser light modulated based on image signals input from a host computer such as a personal computer or a word processor.

The developing unit 100Y is a device for developing a latent image formed on the photoreceptor 10Y with the liquid developer of the invention. The developing unit 100Y will be described in detail below.

The photoreceptor squeeze device 101Y is disposed to face the photoreceptor 10Y on the downstream side of the developing unit 100Y in the rotating direction, and is constituted by a photoreceptor squeeze roller 13Y, a cleaning blade 14Y that is in press-contact with the photoreceptor squeeze roller 13Y and removes the liquid developer adhered to the surface thereof, and a developer recovery part 15Y that recovers the liquid developer removed by the cleaning blade 14Y. The photoreceptor squeeze device 101Y has a function of recovering an excess carrier (insulating liquid) and an essentially unnecessary fogging toner from the developer having been developed on the photoreceptor 11Y to increase a proportion of the toner particles in the developed image.

The primary transfer backup roller 51Y is a device for transferring the monochrome image formed on the photoreceptor 10Y to an intermediate transfer part 40.

The charge removal unit 16Y is a device for removing charge remaining on the photoreceptor 10Y after transferring the intermediate transfer image to the intermediate transfer part 40 by the primary transfer backup roller 51Y.

The photoreceptor cleaning blade 17Y is a rubber member in contact with the surface of the photoreceptor 10Y and has a function of scraping and removing the liquid developer remaining on the photoreceptor 10Y after transferring the image to the intermediate transfer part 40 by the primary transfer backup roller 51Y.

The developer recovery part 15Y has a function of recovering the liquid developer removed by the photoreceptor cleaning blade 17Y.

The intermediate transfer part 40 is an endless elastic belt member and is tensioned by a belt driving roller 41 to which a driving force of a driving motor is transmitted and a pair of driven rollers 44 and 45. The intermediate transfer part 40 is rotationally driven in a counterclockwise direction by the belt driving roller 41 in contact with the photoreceptors 10Y, 10M, 10C and 10K at respective positions of the primary transfer backup rollers 51Y, 51M, 51C and 51K.

A predetermined tension is applied to the intermediate transfer part 40 by a tension roller 49 so that the intermediate transfer part 40 is prevented from loosening. The tension roller 49 is disposed on the downstream side of the driven roller 44 in the rotating (moving) direction of the intermediate transfer part 40 and on the upstream side of the other driven roller 45 in the rotating (moving) direction of the intermediate transfer part 40.

Monochrome images corresponding to the respective colors formed in the developing parts 30Y, 30M, 30C and 30K are transferred sequentially to the intermediate transfer part 40 by the primary transfer backup rollers 51Y, 51M, 51C and 51K, and the monochrome images corresponding to the respective colors are superimposed on one another. In this manner, a full color developer image (intermediate transfer image) is formed on the intermediate transfer part 40.

The intermediate transfer part 40 carries the monochrome images formed on the plural photoreceptors 10Y, 10M, 10C and 10K in a state that these images are successively secondarily transferred so as to be superimposed on one another, and the superimposed images are secondarily transferred at one time to a recoding medium F5 such as paper, film or cloth by a secondary transfer unit 60 described below. For that reason, in transferring the toner image to the recording medium F5 in the secondary transfer process, even in the case of a sheet material in which the surface of the recording medium F5 is not smooth due to a fibrous material, the elastic belt member is employed as a measure for increasing the secondary transfer characteristic for such a non-smooth sheet material surface.

The intermediate transfer part 40 is provided with a cleaning device including an intermediate transfer part cleaning blade 46, a developer recovery part 47 and a non-contact type bias applying member 48.

The intermediate transfer part cleaning blade 46 and the developer recovery part 47 are disposed on a side of the driven roller 45.

The intermediate transfer part cleaning blade 46 has a function of scraping and removing the liquid developer adhered to the intermediate transfer part 40 after transferring the image to the recording medium F5 by the secondary transfer unit (secondary transfer part) 60.

The developer recovery part 47 has a function of recovering the liquid developer removed by the intermediate transfer part cleaning blade 46.

The non-contact type bias applying member 48 is disposed apart from the intermediate transfer part 40 at a position facing the tension roller 49. The non-contact type bias applying member 48 applies a bias voltage having a polarity opposite to that of the toner (solid matter) of the liquid developer remaining on the intermediate transfer part 40 after the secondary transfer to the toner. In this manner, the electric charge is removed from the remaining toner to decrease the electrostatic adhesion force of the toner to the intermediate transfer part 40. In this example, a corona charging device is used as the non-contact type bias applying member 48.

In this connection, the non-contact type bias applying member 48 is not necessarily disposed at the position facing the tension roller 49 and can be disposed at an arbitrary position on the downstream side of the driven roller 44 in the moving direction of the intermediate transfer part 40 and on the upstream side of the other driven roller 45 in the moving direction of the intermediate transfer part 40 such as a position between the driven roller 44 and the tension roller 49. As the non-contact type bias applying member 48, any known non-contact type charging device other than the corona charging device can also be used.

An intermediate transfer part squeeze device 52Y is disposed on the downstream side of the primary transfer backup roller 51Y in the moving direction of the intermediate transfer part 40.

The intermediate transfer part squeeze device 52Y is provided for removing the excess insulating liquid from the liquid developer transferred to the intermediate transfer part 40 in the case where the transferred liquid developer is not in a favorable dispersed state.

The intermediate transfer part squeeze device 52Y is constituted by an intermediate transfer part squeeze roller 53Y, an intermediate transfer part squeeze cleaning blade 55Y that is in press-contact with the intermediate transfer part squeeze roller 53Y and cleans the surface thereof, and a developer recovery part 56Y that recovers the liquid developer removed by the intermediate transfer part squeeze cleaning blade 55Y.

The intermediate transfer part squeeze device 52Y has a function of recovering the excess insulating liquid from the developer primarily transferred to the intermediate transfer part 40 to increase a proportion of the toner particles in the developed image, and also recovering an essentially unnecessary fogging toner.

The secondary transfer unit 60 has a pair of secondary transfer rollers disposed apart from each other at a predetermined distance along the moving direction of the transfer member. In the pair of secondary transfer rollers, the secondary transfer roller disposed on the upstream side in the moving direction of the intermediate transfer part 40 is an upstream side secondary transfer roller 64. This upstream side secondary transfer roller 64 can come in press-contact with the belt driving roller 41 via the intermediate transfer part 40.

In addition, in the pair of secondary transfer rollers, the secondary transfer roller disposed on the downstream side in the moving direction of the transfer member is a downstream side secondary transfer roller 65. This downstream side secondary transfer roller 65 can come in press-contact with the driven roller 44 via the intermediate transfer part 40.

That is, the upstream side secondary transfer roller 64 and the downstream side secondary transfer roller 65 each bring the recording medium F5 into contact with the intermediate transfer part 40 which is tensioned by the belt driving roller 41 and the driven roller 44 and secondarily transfer the intermediate transfer image formed on the intermediate transfer part 40 by superimposing the monochrome images of different colors to the recording medium F5.

In this case, the belt driving roller 41 and the driven roller 44 also function as backup rollers for the upstream side secondary transfer roller 64 and the downstream side secondary transfer roller 65, respectively. That is, the belt driving roller 41 also serves as an upstream side backup roller disposed on the upstream side of the driven roller 44 in the moving direction of the recording medium F5 in the secondary transfer unit 60. Further, the driven roller 44 also serves as a downstream side backup roller disposed on the downstream side of the belt driving roller 41 in the moving direction of the recording medium F5 in the secondary transfer unit 60.

Therefore, the recording medium F5 transported to the secondary transfer unit 60 is brought into close contact with the intermediate transfer part 40 in a predetermined moving region of the transfer member from a position at which press-contact between the upstream side secondary transfer roller 64 and the belt driving roller 41 starts (nip start position) to a position at which press-contact between the downstream side secondary transfer roller 65,and the driven roller 44 ends (nip end position). In this manner, the full color intermediate transfer image on the intermediate transfer part 40 is secondarily transferred to the recording medium F5 in a state of being in close contact with the intermediate transfer part 40 over a predetermined time, and thus, a favorable secondary transfer can be achieved.

The secondary transfer unit 60 includes a secondary transfer roller cleaning blade 66 and a developer recovery part 67 with respect to the upstream side secondary transfer roller 64 and also includes a secondary transfer roller cleaning blade 68 and a developer recovery part 69 with respect to the downstream side secondary transfer roller 65. The secondary transfer roller cleaning blades 66 and 68 are in contact with the secondary transfer rollers 64 and 65, respectively, and scrape and remove the liquid developer remaining on the surfaces of the secondary transfer rollers 64 and 65, respectively, after secondary transfer. The developer recovery parts 67 and 69 each recover And store the liquid developer scraped and removed from the respective secondary transfer rollers 64 and 65 by the respective secondary transfer roller cleaning blades 66 and 68.

The toner image (transfer image) F5*a* transferred to the recording medium F5 by the secondary transfer unit 60 is transported to a fixing part (fixing device) F40 and fixed to the recording medium F5 by heating and pressing.

The fixing temperature is preferably from 80-160° C., more preferably from 100-150° C., and further more preferably from 100-140° C.

The developing units 100Y, 100M, 100C and 100K will now be described in detail in the following description, the developing unit 100Y will be described as a representative example.

As shown in FIG. 2, the developing unit 100Y has a liquid developer storage part 31Y, a coating roller 32Y, a control blade 33Y, a developer stirring roller 34Y, a communication channel 35Y, a recovery screw 36Y, a developing roller 20Y and a developing roller cleaning blade 21Y.

The liquid developer storage part 31Y has a function of storing the liquid developer for developing a latent image formed on the photoreceptor 10Y and is provided with a feed part 31*a*Y that feeds the liquid developer to the developing part, a recovery part 31*b*Y that recovers the excess liquid developer generated in the feed part 31*a*Y and the like, and a partition 31*c*Y that separates the feed part 31*a*Y and the recovery part 31*b*Y.

The feed part 31*a*Y has a function of feeding the liquid developer to the coating roller 32Y and has a concave portion in which the developer stirring roller 34Y is installed. The liquid developer is fed to the feed part 31*a*Y through the communication channel 35Y from a liquid developer mixing bath 93Y.

The recovery part 31*b*Y recovers liquid developer excessively fed to the feed part 31*a*Y and excess liquid developer generated in the developer recovery parts 15Y and 24Y. The recovered liquid developer is transported to the liquid developer mixing bath 93Y described below for reuse. The recovery part 31*b*Y has a concave portion and a recovery screw 36Y is installed in the vicinity of the bottom of the concave portion.

At the boundary between the feed part 31*a*Y and the recovery part 31*b*Y, the wall-like partition 31*c*Y is provided. The partition 31*c*Y separates the feed part 31*a*Y and the recovery part 31*b*Y and can prevent contamination of the fresh liquid developer with the recovered liquid developer. When liquid developer is excessively fed to the feed part 31*a*Y, the excess liquid developer can be allowed to overflow from the feed part 31*a*Y to the recovery part 31*b*Y across the partition 31*c*Y. Therefore, the amount of the liquid developer in the feed part 31*a*Y can be maintained constant, and the amount of the liquid developer to be fed to the coating roller 32Y can be maintained constant. As a result, the quality of the finally formed image becomes stable.

The partition 31*c*Y has a notch, and the liquid developer can be allowed to overflow from the feed part 31*a*Y to the recovery part 31*b*Y through the notch.

The coating roller 32Y has a function of feeding the liquid developer to the developing roller 20Y.

The coating roller 32Y is a so-called anilox roller which is a roller made of a metal such as iron, having grooves formed uniformly and spirally on the surface thereof and having been plated with nickel, and has a diameter of about 25 mm. In this embodiment, plural grooves are formed slantwise with respect to the rotating direction of the coating roller 32Y by a so-called cutting process, rolling process or the like. The coating roller 32Y is in contact with the liquid developer while rotating counterclockwise to retain the liquid developer in the feed part 31*a*Y in the grooves, and transports the retained liquid developer to the developing roller 20Y.

The control blade 33Y is in contact with the surface of the coating roller 32Y to control the amount of the liquid developer on the coating roller 32Y. That is, the control blade 33Y plays a role in measuring an amount of the liquid developer on the coating roller 32Y to be fed to the developing roller 20Y by scraping and removing the excess liquid developer on the coating roller 32Y. This control blade 33Y is formed of urethane rubber as an elastic material and supported by a control blade supporting member made of a metal such as iron. The control blade 33Y is disposed on a side where the coating roller 32Y rotates and comes out from the liquid developer (i.e., on a right side in FIG. 2). The control blade 33Y has a rubber hardness of about 77 according to JIS-A, and the hardness of the control blade 33Y at the part in contact with the surface of the coating roller 32Y (about 77) is lower than that of the elastic layer of the developing roller 20Y described below at the part in press-contact with the surface of the coating roller 32Y (about 85). Further, the excess liquid developer thus scraped off is recovered in the feed part 31*a*Y for reuse.

The developer stirring roller 34Y has a function of stirring the liquid developer to form a uniformly dispersed liquid developer. According to this, even in the case where plural toner particles are aggregated, the respective toner particles can be favorably dispersed. In particular, the liquid developer of the invention is excellent in dispersion stability and also redispersibility, therefore, even in the case of the used liquid developer, the toner particles can be easily dispersed.

In the feed part 31*a*Y, the toner particles in the liquid developer have a positive charge, and the liquid developer is in a uniformly dispersed state by stirring with the developer stirring roller 34Y and is drawn up from the liquid developer storage part 31Y through rotation of the coating roller 32Y, and then fed to the developing roller 20Y while controlling the amount of the liquid developer by the control blade 33Y. Through stirring of the liquid developer by the developer stirring roller 34Y, the liquid developer can be allowed to stably overflow across the partition 31*c*Y to the side of the recovery part 31*b*Y, whereby the liquid developer is prevented from being retained and compressed.

The developer stirring roller 34Y is installed in the vicinity of the communication channel 35Y. Therefore, the liquid developer fed from the communication channel 35Y can be promptly diffused, and even in the case where the liquid developer is being replenished to the feed part 31*a*Y, the level of the liquid in the feed part 31*a*Y can be maintained constant. By installing such a developer stirring roller 34Y in the vicinity of the communication channel 35Y, a negative pressure is generated in the communication channel 35Y, and therefore, the liquid developer can be naturally sucked up.

The communication channel 35Y is provided vertically beneath the developer stirring roller 34Y and communicates with the liquid developer storage part 31Y, and through which the liquid developer is sucked up from the liquid developer mixing bath 93Y to the feed part 31*a*Y.

By installing the communication channel 35Y beneath the developer stirring roller 34Y, the liquid developer fed through the communication channel 35Y is held back by the developer stirring roller 34Y and the liquid level is prevented from rising due to ejection of the liquid developer and the liquid level is maintained substantially constant, whereby the liquid developer can be stably fed to the coating roller 32Y.

The recovery screw 36Y installed in the vicinity of the bottom of the recovery part 31*b*Y is formed of a cylindrical material, has spiral ribs on the outer periphery thereof, and has a function of maintaining the fluidity of the recovered liquid developer and also has a function of accelerating the transport of the liquid developer to the liquid developer mixing bath 93Y.

The developing roller 20Y retains the liquid developer and transports it to the developing position facing the photoreceptor 10Y for developing the latent image carried on the photoreceptor 10Y with the liquid developer.

The developing roller 20Y has a liquid developer layer formed on the surface thereof by feeding the liquid developer from the coating roller 32Y.

The developing roller 20Y includes an inner core made of a metal such as iron and an electroconductive elastic layer provided on the outer periphery of the core, and has a diameter of about 20 mm. The elastic layer has a two-layer structure including a urethane rubber layer having a rubber hardness of about 30 according to JIS-A and a thickness of about 5 mm as an inner layer, and a urethane rubber layer having a rubber hardness of about 85 according to JIS-A and a thickness of about 30 μm as a surface (outer) layer. The developing roller 20Y is in press-contact with the coating roller 32Y and the photoreceptor 10Y while the surface layer is serving as a press-contact portion in an elastically deformed state.

The developing roller 20Y is rotatable about the center axis thereof, and the center axis is located down below the rotation center axis of the photoreceptor 10Y. The developing roller 20Y rotates in the direction (the counterclockwise direction in FIG. 2) opposite to the rotating direction (the clockwise direction in FIG. 2) of the photoreceptor 10Y. When the latent image formed on the photoreceptor 10Y is developed, an electric field is generated between the developing roller 20Y and the photoreceptor 10Y.

In the developing unit 100Y, the coating roller 32Y and the developing roller 20Y are separately driven by different power sources Therefore, by changing a ratio of a rotation speed (linear velocity) of the coating roller 32Y to that of the developing roller 20Y, an amount of the liquid developer to be fed on the developing roller 20Y can be adjusted.

The developing unit 100Y has a developing roller cleaning blade 21Y made of rubber and provided in contact with the surface of the developing roller 20Y and a developer recovery part 24Y. The developing roller cleaning blade 21Y is a device for scraping and removing the liquid developer remaining on the developing roller 20Y after the development is carried out at the developing position. The liquid developer removed by the developing roller cleaning blade 21Y is recovered in the developer recovery part 24Y.

As shown in FIGS. 1 and 2, the image forming apparatus 1000 is provided with the liquid developer replenishing parts 90Y, 90M, 90C and 90K that replenish the liquid developers to the developing parts 30Y, 30M, 30C and 30K, respectively. These liquid developer replenishing parts 90Y, 90M, 90C and 90K have liquid developer tanks 91Y, 91M, 91C and 91K, insulating liquid tanks 92Y, 92M, 92C and 92K, and liquid developer mixing baths 93Y, 93M, 93C and 93K, respectively.

In each of the liquid developer tanks 91Y, 91M, 91C and 91K, a liquid developer of high concentration that corresponds to each of the respective colors is stored. Further, in each of the insulating liquid tanks 92Y, 92M, 92C and 92K, the insulating liquid is stored. Further, to each of the liquid developer mixing baths 93Y, 93M, 93C and 93K, a predetermined amount of each liquid developer of high concentration is fed from each of the liquid developer tanks 91Y, 91M, 91C and 91K and a predetermined amount of each insulating liquid is fed from each of the insulating liquid tanks 92Y, 92M, 92C and 92K.

In each of the liquid developer mixing baths 93Y, 93M, 93C and 93K, the fed liquid developer of high concentration and the fed insulating liquid are mixed and stirred by a stirring device installed in each bath to prepare a liquid developer corresponding to each of the respective colors that is to be used in each of the feed parts 31*a*Y, 31*a*M, 31*a*C and 31*a*K. The liquid developers prepared in the respective liquid developer mixing baths 93Y, 93M, 93C and 93K are fed to the corresponding feed parts 31*a*Y, 31*a*M, 31*a*C and 31*a*K.

In the liquid developer mixing bath 93Y, the liquid developer recovered by the recovery part 31*b*Y is recovered for reuse. The same applies to the liquid developer mixing baths 93M, 93C and 93K. Here, the toner particles are obtained by modifying the surfaces of the toner mother particles containing the rosin resin with the polyalkyleneimine as described above and the polyalkyleneimine is rigidly attached to the surfaces of the toner mother particles. Therefore, even if stress involved in the recovering procedure (for example, stress caused by the cleaning blade) is applied to the toner particles, detachment or release of the polyalkyleneimine from the toner mother particles is surely prevented, and further, the toner particles as described above have high redispersibility in the insulating liquid. Accordingly, the recovered toner particles can be favorably reused for image formation.

The invention has been described with reference to particular embodiments, however, the invention is not limited to these embodiments.

For example, the liquid developer of the invention is not limited to those applied to an image forming apparatus as described above.

Further, the liquid developer of the invention is not limited to those produced by a production process as described above.

Further, in the above-mentioned embodiments, it is described that coalescent particles are obtained by preparing an aqueous emulsion liquid and adding an electrolyte to the prepared aqueous emulsion liquid, however, the invention is not limited thereto. For example, the coalescent particles may be prepared using an emulsion polymerization association method in which a colorant, a monomer, a surfactant and a polymerization initiator are dispersed in an aqueous liquid, and an aqueous emulsion liquid is prepared by emulsion polymerization, and then an electrolyte is added to the aqueous emulsion liquid to effect association. Further, the coalescent particles may be prepared by subjecting the obtained aqueous emulsion liquid to spray drying.

Further, in the above-mentioned embodiments, an image forming apparatus including a corona discharging device is described, however, the apparatus may not include a corona discharging device.

EXAMPLES

1. Production of Liquid Developer

A liquid developer was produced as described below. Steps in which a temperature is not specified were performed at room temperature (25° C.).

Example 1

Dispersion Liquid Providing Step (Aqueous Dispersion Liquid Providing Step)

Preparation of Colorant Master Solution

First, 60 parts by weight of a polyester resin (acid value: 10 mg KOH/g, glass transition point (Tg): 55° C., softening point: 107° C.) was provided as a resin material.

Subsequently, a mixture of the above resin material and a cyan pigment (Pigment Blue 15:3, manufactured by Dainichiseika Color & Chemicals Mfg. Co., Ltd.) as a colorant at a mass ratio of 50:50 was prepared. These components were mixed using a 20-L Henschel mixer, whereby a raw material for producing a toner was obtained.

Then, the raw material (mixture) was kneaded using a twin-screw kneading extruder. The kneaded material extruded from the extrusion port of the twin-screw kneading extruder was cooled.

The thus cooled kneaded material was coarsely pulverized to prepare a colorant master batch having an average particle diameter of 1.0 mm or less. A hammer mill was used for coarse pulverization of the kneaded material.

Resin Solution Preparing Step 175 parts by weight of methyl ethyl ketone, 172.3 parts by weight of the polyester resin, and 55.3 parts by weight of a rosin-modified maleic resin (trade name "Malkyd No. 1", manufactured by Arakawa Chemical Industries, Ltd., acid value: 25 mg KOH/g or less, softening point: 120 to 130° C., weight average molecular weight: 3100) were mixed in 97.5 parts by weight of the above-mentioned colorant master batch using a high-speed disperser (T.K. Robomix/T.K. Homo Disper Model 2.5, manufactured by Primix Corporation). Then, 1.38 parts by weight of NEOGEN SC-F (manufactured by Dai-ichi Kogyo Seiyaku Co., Ltd.) as an emulsifying agent was added to the mixture to prepare a resin solution. In this solution, the pigment was uniformly and finely dispersed.

O/W Emulsion Liquid Preparing Step

Subsequently, 72.8 parts by weight of 1 N ammonia water was added to the resin solution in a vessel and the mixture was sufficiently stirred using a high-speed disperser (T.K. Robomix/T.K. Homo Disper Model 2.5, manufactured by Primix Corporation) by setting a blade tip speed of the stirring blade to 7.5 m/s and then, a temperature of the solution in the flask was adjusted to 25° C. Thereafter, while stirring the mixture by setting a blade tip speed of the stirring blade to 14.7 m/s, 400 parts by weight of deionized water was added dropwise thereto. Further, while continuing stirring, 100 parts by weight of deionized water was added thereto, whereby an O/W emulsion liquid in which dispersoids containing the resin material were dispersed was obtained via a W/O emulsion liquid.

Coalescing Step

Subsequently, the O/W emulsion liquid was transferred to a stirring vessel having a max blend blade, and a temperature of the O/W emulsion liquid was adjusted to 25° C. while stirring the O/W emulsion liquid by setting a blade tip speed of the stirring blade to 1.0 m/s. Subsequently, coalescent particles were formed by adding 200 parts by weight of a 5.0% aqueous solution of sodium sulfate dropwise to the O/W emulsion liquid while maintaining the same temperature and stirring conditions to coalesce the dispersoids. After completion of the dropwise addition, the mixture was kept stirring until the coalescent particles grew to a 50% volume particle diameter Dv(50) (μm) of 2.5 μm. When the Dv(50) of the coalescent particles reached 2.5 μm, 200 parts by weight of deionized water was added thereto and coalescence was finished Organic Solvent Removing Step The organic solvent was distilled off until the solid content became 23 wt % by placing the O/W emulsion liquid containing the coalescent particles under reduced pressure, whereby a toner mother particle slurry (dispersion liquid) was obtained.

Washing Step (First Washing Step)

Subsequently, the thus obtained slurry (dispersion liquid) was subjected to solid-liquid separation, and a procedure of redispersion in water (reslurry) and solid-liquid separation was performed repeatedly to effect a washing treatment. The washing treatment was performed until the electrical conductivity of a supernatant of the slurry became 20 μS/cm or less.

Thereafter, a wet cake of the toner mother particles (toner mother particle cake) was obtained by suction filtration. This wet cake was then dispersed in water, whereby a dispersion liquid (aqueous dispersion liquid) containing the washed toner mother particles was obtained.

Surface Modifying Step

Subsequently, 1 N hydrochloric acid was added to the dispersion liquid (aqueous dispersion liquid) containing the washed toner mother particles to adjust the hydrogen ion exponent (pH) to 4.0.

Then, to the dispersion liquid (aqueous dispersion liquid) having a hydrogen ion exponent (pH) adjusted to 4.0, polyethyleneimine (number average molecular weight: 70000) was added dropwise while stirring. At this time, polyethyleneimine was added in an amount of 1.0 part by weight based on 100 parts by weight of the rosin resin. Thereafter, the resulting mixture was sufficiently stirred such that the entire dispersion liquid had a sufficiently uniform composition.

Washing Step (Second Washing Step)

The thus obtained dispersion liquid in which the toner particles were dispersed was then subjected to solid-liquid separation, and a procedure of redispersion in water (reslurry) and solid-liquid separation was performed repeatedly to effect a washing treatment. Thereafter, a wet cake of the toner particles (toner particle cake) was obtained by suction filtration. A content of water in the thus obtained wet cake was 35 wt %. When the liquid phase separated by the solid-liquid separation and the filtrate were examined, polyethyleneimine was not detected.

Drying Step

Thereafter, the thus obtained wet cake was dried using a vacuum dryer, whereby toner particles obtained by modifying (chemically modifying) the surfaces of the toner mother particles with polyethyleneimine were obtained.

Insulating Liquid Dispersing Step 50 parts by weight of the toner particles obtained by the above-mentioned method, and as an insulating liquid, 120 parts by weight of rapeseed oil (trade name "high-oleic rapeseed oil" manufactured by The Nisshin Oillio Group, Ltd.) and 80 parts by weight of soybean oil fatty acid methyl ester (manufactured by The Nisshin Oillio Group, Ltd.) were placed in a ceramic pot (internal capacity: 600 mL), and further zirconia balls (ball diameter: 1 mm) were placed in the ceramic pot such that a volume filling ratio became 85%. Then, the mixture in the pot was dispersed using a desktop pot mill at a rotation speed of 230 rpm for 24 hours, and thus a liquid developer was obtained.

The toner particles in the thus obtained liquid developer had a Dv(50) of 1.95 μm. The 50% volume particle diameter Dv(50) (μm) of the obtained toner particles was measured using MICRO-TRACK MT-3000 (manufactured by Nikkiso Co., Ltd.). The particle diameters of particles obtained in the respective Examples and Comparative examples described below were determined in the same manner.

A viscosity of the obtained liquid developer at 25° C. was 50 mPa·s.

A magenta liquid developer, a yellow liquid developer and a black liquid developer were produced in the same manner as described above except that a magenta pigment (Pigment Red 238, manufactured by Sanyo Color Works, Ltd.), a yellow pigment (Pigment yellow 180, manufactured by Clariant), a black pigment (carbon black Printex L, manufactured by Degussa) were used, respectively, instead of the cyan pigment.

Examples 2-24

Liquid developers corresponding to the respective colors were produced in the same manner as in Example 1 except that the types of rosin resin and resin material other than the rosin resin, the type and used amount of the polyalkyleneimine, the hydrogen ion exponent (pH) of the dispersion liquid (aqueous dispersion liquid) having an adjusted hydrogen ion exponent (pH) in the surface modifying step and the like were changed as shown in Table 1.

Comparative Example 1

Liquid developers corresponding to the respective colors were produced in the same manner as in Example 1 except that the rosin resin was not used and the used amount of the polyester resin was increased by just that much. When the liquid phase separated by the solid-liquid separation and the filtrate in the washing step (second washing step) were examined, it was confirmed that the polyalkyleneimine was contained.

Comparative Example 2

Liquid developers corresponding to the respective colors were produced in the same manner as in Example 1 except that Arakyd 251 (manufactured by Arakawa Chemical Industries, Ltd.) as a dispersant was used instead of the polyalkyleneimine.

Comparative Example 3

Liquid developers corresponding to the respective colors were produced in the same manner as in Example 1 except that the surface modifying step between the first washing step and the second washing step was omitted and, instead, a step of adding the polyalkyleneimine to the insulating liquid in which the toner mother particles were dispersed was performed after the insulating liquid dispersing step.

With regard to the respective Examples and Comparative examples, the resin materials used for preparation of the liquid developers, the polyalkyleneimine (in Comparative example 2, not the polyalkyleneimine but the dispersant), the conditions of the insulating liquid, the viscosities of the liquid developers, the hydrogen ion exponent (pH after adjustment of the dispersion liquid) of the dispersion liquid (aqueous dispersion liquid) having an adjusted hydrogen ion exponent (pH) in the surface modifying step and the like are shown in Table 1. In the table, the polyester resin (acid value: 10 mg KOH/g, glass transition point (Tg): 55° C., softening point: 107° C.) is denoted by PES; the styrene-acrylic ester copolymer is denoted by ST-AC; the rosin-modified polyester resin (trade name "TFS-015", manufactured by Arakawa Chemical Industries, Ltd., acid value: 11.8 mg KOH/g, softening point: 79° C., weight average molecular weight: 1300) is denoted by RPES; the rosin-modified phenol resin (trade name "Tamanor 135", manufactured by Arakawa Chemical Industries, Ltd., acid value: 18 mg KOH/g or less, softening point: 130 to 140° C., weight average molecular weight: 15000) is denoted by RPH; the rosin-modified maleic resin (trade name "Malkyd No. 1", manufactured by Arakawa Chemical Industries, Ltd., acid value: 25 mg KOH/g or less, softening point: 120 to 130° C., weight average molecular weight: 3100) is denoted by RM; polyethyleneimine is denoted by PEI; and Arakyd 251 is denoted by DA. In Comparative example 2, the conditions of the dispersant are shown in the columns of the polyalkyleneimine.

TABLE 1

| | Liquid developer | | | | | | | | | | | | | |
|---|---|---|---|---|---|---|---|---|---|---|---|---|---|---|
| | Toner mother particles | | | | | Polyalkyleneimine | | | | | | | | |
| | Resin material | | | | | | | | | | | | | |
| | Rosin resin | | Resin material other than rosin resin | | With or without surface modification with polyalkyleneimine | | | Used amount based on 100 parts by weight of rosin resin (parts by weight) | Insulating liquid | | | | | PH after adjustment of dispersion liquid |
| | Type | Content in resin material (wt %) | Type | Content in resin material (wt %) | | Type | Weight average molecular weight | | Type | Content in insulating liquid (wt %) | Type | Content in insulating liquid (wt %) | Viscosity (mPa · s) | |
| Example 1 | RM | 20 | PES | 80 | With | PEI | 70000 | 1.0 | NT | 60 | ME | 40 | 50 | 4.0 |
| Example 2 | RM | 20 | PES | 80 | With | PEI | 70000 | 0.5 | NT | 60 | ME | 40 | 48 | 4.0 |
| Example 3 | RM | 20 | PES | 80 | With | PEI | 70000 | 0.25 | NT | 60 | ME | 40 | 48 | 4.0 |
| Example 4 | RM | 20 | PES | 80 | With | PEI | 70000 | 0.125 | NT | 60 | ME | 40 | 49 | 4.0 |
| Example 5 | RM | 20 | PES | 80 | With | PEI | 10000 | 1.0 | NT | 60 | ME | 40 | 52 | 4.0 |
| Example 6 | RM | 20 | PES | 80 | With | PEI | 10000 | 0.5 | NT | 60 | ME | 40 | 55 | 4.0 |
| Example 7 | RM | 20 | PES | 80 | With | PEI | 10000 | 0.25 | NT | 60 | ME | 40 | 48 | 4.0 |
| Example 8 | RM | 20 | PES | 80 | With | PEI | 10000 | 0.125 | NT | 60 | ME | 40 | 54 | 4.0 |
| Example 9 | RM | 20 | PES | 80 | With | PEI | 1800 | 1.0 | NT | 60 | ME | 40 | 52 | 4.0 |
| Example 10 | RM | 20 | PES | 80 | With | PEI | 600 | 1.0 | NT | 60 | ME | 40 | 55 | 4.0 |
| Example 11 | RM | 45 | PES | 55 | With | PEI | 70000 | 1.0 | NT | 60 | ME | 40 | 48 | 4.0 |
| Example 12 | RPH | 20 | PES | 80 | With | PEI | 70000 | 1.0 | NT | 60 | ME | 40 | 50 | 4.0 |
| Example 13 | RPH | 20 | PES | 80 | With | PEI | 70000 | 0.5 | NT | 60 | ME | 40 | 48 | 4.0 |
| Example 14 | RPH | 20 | PES | 80 | With | PEI | 10000 | 1.0 | NT | 60 | ME | 40 | 54 | 4.0 |
| Example 15 | RPH | 20 | PES | 80 | With | PEI | 10000 | 0.5 | NT | 60 | ME | 40 | 49 | 4.0 |
| Example 16 | RPES | 20 | PES | 80 | With | PEI | 70000 | 1.0 | NT | 60 | ME | 40 | 52 | 4.0 |
| Example 17 | RPES | 20 | PES | 80 | With | PEI | 70000 | 0.5 | NT | 60 | ME | 40 | 52 | 4.0 |
| Example 18 | RPES | 20 | PES | 80 | With | PEI | 10000 | 1.0 | NT | 60 | ME | 40 | 54 | 4.0 |
| Example 19 | RPES | 20 | PES | 80 | With | PEI | 10000 | 0.5 | NT | 60 | ME | 40 | 48 | 4.0 |
| Example 20 | RM | 20 | ST-AC | 80 | With | PEI | 70000 | 1.0 | NT | 60 | ME | 40 | 49 | 4.0 |
| Example 21 | RM | 20 | PES | 80 | With | PEI | 70000 | 1.0 | NT | 60 | ME | 40 | 50 | 5.5 |
| Example 22 | RM | 20 | PES | 80 | With | PEI | 70000 | 1.0 | NT | 60 | ME | 40 | 47 | 7.0 |
| Example 23 | RM | 20 | PES | 80 | With | PEI | 70000 | 1.0 | NT | 60 | ME | 40 | 52 | 8.0 |
| Example 24 | RM | 20 | PES | 80 | With | PEI | 70000 | 1.0 | NT | 60 | ME | 40 | 50 | 3.7 |
| Comparative Example 1 | — | — | PES | 100 | Without | PEI | 70000 | 1.0 | NT | 60 | ME | 40 | 49 | 4.0 |
| Comparative Example 2 | RPES | 20 | PES | 80 | Without | DA | — | 1.0 | NT | 60 | ME | 40 | 47 | 4.0 |
| Comparative Example 3 | RPES | 20 | PES | 80 | Without | PEI | 70000 | 1.0 | NT | 60 | ME | 40 | 48 | 4.0 |

2. Evaluation

The respective liquid developers obtained as described above were evaluated as follows.

2.1 Development Efficiency

Using an image forming apparatus as shown in FIGS. 1 and 2, a liquid developer layer was formed on the developing roller of the image forming apparatus with each of the liquid developers obtained in the above-mentioned respective Examples and Comparative examples. A surface potential of the developing roller was then set to 300 V, and the photoreceptor was uniformly charged so as to have a surface potential of 500 V. Then, the charge of the surface of the photoreceptor was reduced by irradiating the photoreceptor with light thereby decreasing the surface potential thereof to 50 V. The toner particles on the developing roller and the photoreceptor behind the point at which the liquid developer layer passed between the photoreceptor and the developing roller were collected using tapes, respectively. Each tape used for collecting the toner particles was stuck on a recording paper and a density of the toner particles on each tape was measured. After the measurement, a value obtained by dividing the density of the toner particles collected on the photoreceptor by the sum of the densities of the toner particles collected on the photoreceptor and the developing roller and then multiplying the resulting value by 100 was calculated as a development efficiency, which was then evaluated into the following four grades.

A: The development efficiency is 96% or more, and the development efficiency is particularly excellent.

B: The development efficiency is 90% or more and less than 96%, and the development efficiency is excellent.

C: The development efficiency is 80% or more and less than 90%, and there is no practical problem.

D: The development efficiency is less than 80%, and the development efficiency is poor.

2.2. Transfer Efficiency

Using an image forming apparatus as shown in FIGS. 1 and 2, a liquid developer layer was formed on the photoreceptor of the image forming apparatus with each of the liquid developers obtained in the respective Examples and Comparative examples. Subsequently, the toner particles on the photoreceptor and the intermediate transfer part behind the point at which the liquid developer layer passed between the photoreceptor and the intermediate transfer part were collected using tapes, respectively. Each tape used for collecting the toner particles was stuck on a recording paper and a density of the toner particles on each tape was measured. After the measurement, a value obtained by dividing the density of the toner particles collected on the intermediate transfer part by the sum of the densities of the toner particles collected on the photoreceptor and the intermediate transfer part and then multiplying the resulting value by 100 was determined to be a transfer efficiency, which was then evaluated into the following four grades.

A: The transfer efficiency is 96% or more, and the transfer efficiency is particularly excellent.

B: The transfer efficiency is 90% or more and less than 96%, and the transfer efficiency is excellent.

C: The transfer efficiency is 80% or more and less than 90%, and there is no practical problem.

D: The transfer efficiency is less than 80%, and the transfer efficiency is poor.

2.3. Fixing Strength using an image forming apparatus as shown in FIGS. 1 and 2, an image having a predetermined pattern was formed on a recording paper (High quality paper LPCPPA4 manufactured by Seiko Epson Corporation) with each of the liquid developers obtained in the respective Examples and Comparative examples. Then, the image formed on the paper was thermally fixed on the paper by setting the fixing temperature to 100° C.

After confirming a non-offset region, the fixed image on the recording paper was then rubbed out twice using an eraser (a sand eraser "LION 261-111", manufactured by LION OFFICE PRODUCTS CORP.) at a press load of 1.2 kgf. Then, the residual ratio of the image density on the recording paper was measured by "X-Rite model 404" manufactured by X-Rite Inc., which was then evaluated into the following five grades.

A: The residual ratio of the image density is 96% or more (very good).

B: The residual ratio of the image density is 90% or more and less than 96% (good).

C: The residual ratio of the image density is 80% or more and less than 90% (moderate).

D: The residual ratio of the image density is 70% or more and less than 80% (somewhat bad).

E: The residual ratio of the image density is less than 70% (very bad).

2.4. Positive Chargeability

A potential difference of each of the liquid developers obtained in the respective Examples and Comparative examples was measured using a microscope laser zeta potentiometer "ZC-2000" manufactured by Microtec Nition Corporation, which was then evaluated into the following five grades.

The measurement was performed as follows. Each liquid developer was diluted with a dilution solvent and placed in a transparent 10×10 mm square cell. Then, a voltage of 300 V was applied between electrodes (distance of electrodes: 9 mm), and at the same time, movement of the particles in the cell was observed with a microscope to calculate their moving speed, and a zeta potential was obtained based on the calculated value of the moving speed.

A: The potential difference is +100 mV or more (very good).

B: The potential difference is +85 mV or more and less than +100 mV (good).

C: The potential difference is +70 mV or more and less than +85 mV (moderate).

D: The potential difference is +50 mV or more and less than +70 mV (somewhat bad).

E: The potential difference is less than +50 mV (very bad).

2.5. Dispersion Stability Test 2.5.1. Method 1

10 mL of each of the liquid developers obtained in the respective Examples and Comparative examples was placed in a test tube (diameter: 12 mm, length: 120 mm), and the test tube was left stand for 10 days. Then, a depth of sediment was measured, which was evaluated into the following four grades.

A: The depth of sediment is 0 mm.

B: The depth of sediment is more than 0 mm and 2 mm or less.

C: The depth of sediment is more than 2 mm and 5 mm or less.

D: The depth of sediment is more than 5 mm.

2.5.2. Method 2

45.5 mL of each of the liquid developers obtained in the respective Examples and Comparative examples was placed in a centrifuge tube and centrifuged for 3 minutes using a centrifuge (manufactured by Kokusan Co., Ltd.) under conditions that the rotation radius was 5 cm and the rotation speed was 500, 1000, 2000, 4000 or 5000 rpm. Then, a depth of sediment was measured for each rotation speed.

The centrifugal acceleration ($r\omega^2$) ($r\omega^2$=1118×(rotation radius (cm))×(rotations per minute (rpm))$^2$×$10^{-8}$×g (gravitational acceleration)) was taken along the abscissa, the depth of sediment was taken along the ordinate, and the measurement results were plotted. A slope k was determined through linear approximation based on the respective plots, which was then evaluated into the following four grades. Incidentally, it can be said that as the value of k is lower, the dispersion stability is higher.

A: $0 \leqq k < 0.004$

B: $0.004 \leqq k < 0.008$

C: $0.008 \leqq k < 0.012$

D: $0.012 \leqq k$ 2.6. Recyclability

Using an image forming apparatus as shown in FIGS. 1 and 2, an image having a predetermined pattern was formed on 10000 sheets of recording paper (High quality paper LPCPPA4 manufactured by Seiko Epson Corporation) with each of the liquid developers obtained in the respective Examples and Comparative examples. This image formation was performed in a condition that supply of the liquid developer from each of the liquid developer tanks of respective colors to each of the corresponding stirring devices of respective colors was stopped. After image formation on 10000 sheets of recording paper was completed, a liquid developer recycled by diluting the toner particles recovered in each of the stirring devices with the insulating liquid such that a solid content became 20 wt % (recycled liquid developer) was tested by two methods (Method 1 and Method 2) as described below and evaluated for applicability to recycling (recyclability).

2.6.1. Method 1

10 mL of each of the recycled liquid developers for the respective Examples and Comparative examples was placed in a test tube (diameter: 12 mm, length: 120 mm), and the test tube was left stand for 10 days. Then, a depth of sediment was measured, which was evaluated into the following four grades.

A: The depth of sediment is 1 mm or less.

B: The depth of sediment is more than 1 mm and 3 mm or less.

C: The depth of sediment is more than 3 mm and 6 mm or less.

D: The depth of sediment is more than 6 mm.

2.6.2. Method 2

45.5 mL of each of the recycled liquid developers for the respective Examples and Comparative examples was placed in a centrifuge tube and centrifuged for 3 minutes using a centrifuge (manufactured by Kokusan Co., Ltd.) under conditions that the rotation radius was 5 cm and the rotation speed was 500, 1000, 2000, 4000 or 5000 rpm. Then, a depth of sediment was measured for each rotation speed.

The centrifugal acceleration ($r\omega^2$) ($r\omega^2 = 1118 \times$(rotation radius (cm))$\times$(rotations per minute (rpm))$^2 \times 10^{-8} \times g$ (gravitational acceleration)) was taken along the abscissa, the depth of sediment was taken along the ordinate, and the measurement results were plotted. A slope k was determined through linear approximation based on the respective plots, which was then evaluated into the following four grades. Incidentally, it can be said that as the value of k is lower, the dispersion stability is higher.

A: $0 \leqq k < 0.006$

B: $0.006 \leqq k < 0.010$

C: $0.010 \geqq k < 0.014$

D: $0.014 \leqq k$

These results are shown in Table 2.

TABLE 2

| | Development efficiency | Transfer efficiency | Fixing strength | Positive chargeability | Dispersion stability | | Recyclability | |
|---|---|---|---|---|---|---|---|---|
| | | | | | Method 1 | Method 2 | Method 1 | Method 2 |
| Example 1 | A | A | A | A | A | A | A | A |
| Example 2 | A | A | A | A | A | B | A | B |
| Example 3 | B | B | A | A | A | B | B | B |
| Example 4 | B | B | A | B | B | B | B | B |
| Example 5 | A | A | A | A | A | A | A | A |
| Example 6 | A | A | A | A | A | A | A | B |
| Example 7 | B | B | A | A | A | B | B | B |
| Example 8 | C | B | A | B | A | B | B | B |
| Example 9 | B | B | A | B | B | B | B | B |
| Example 10 | C | C | A | B | B | B | B | B |
| Example 11 | A | A | A | A | A | A | A | A |
| Example 12 | B | B | B | B | A | A | A | A |
| Example 13 | C | B | B | B | A | A | A | A |
| Example 14 | B | B | B | B | A | A | A | A |
| Example 15 | C | B | B | B | A | A | A | A |
| Example 16 | A | A | A | A | B | B | B | B |
| Example 17 | B | B | A | B | B | B | B | B |
| Example 18 | A | A | A | A | B | B | B | B |
| Example 19 | B | B | A | B | B | B | B | B |
| Example 20 | A | A | B | A | A | A | A | A |
| Example 21 | B | B | A | A | A | B | B | B |
| Example 22 | C | C | A | B | B | B | B | B |
| Example 23 | C | C | A | B | B | B | B | B |
| Example 24 | B | B | B | B | A | A | A | A |
| Comparative Example 1 | C | D | A | E | D | D | D | D |
| Comparative Example 2 | C | C | A | D | C | D | D | D |
| Comparative Example 3 | C | C | A | D | C | D | D | D |

As is apparent from Table 2, the liquid developers according to the invention were excellent in chargeability (positive chargeability) and long-term dispersion stability of toner particles. Further, the liquid developers according to the invention were also excellent in recyclability. Further, the liquid developers according to the invention are also excellent in development efficiency, transfer efficiency and fixing strength. On the other hand, from the liquid developers of the Comparative examples, satisfactory results could not be obtained.

Further, using an image forming apparatus as shown in FIGS. 1 and 2, continuous image formation was performed on 50000 sheets of recording paper (High quality paper LPCPPA4 manufactured by Seiko Epson Corporation) in a condition that the liquid developer was supplied from each of the liquid developer mixing baths of respective colors to each of the corresponding feed parts of respective colors. As a result, in the case of using the liquid developers according to the invention, an image with an excellent image quality could be formed even on the 50000th sheet and deterioration of image quality was not observed, however, in the case of using the liquid developers of Comparative examples, apparent deterioration of image quality was observed.

What is claimed is:

1. A liquid developer comprising:

an insulating liquid; and toner particles obtained by modifying a toner mother particles containing a rosin resin with a polyalkyleneimine.

2. The liquid developer according to claim l, wherein the polyalkyleneimine has a number average molecular weight of from 5000-100000.

3. The liquid developer according to claim 1, wherein the polyalkyleneimine is polyethyleneimine.

4. The liquid developer according to claim 1, wherein the toner particles further include a resin material having an ester bond other than the rosin resin.

5. The liquid developer according to claim 1, wherein the rosin resin has a softening point of from 80-190° C.

6. The liquid developer according to claim 1, wherein the rosin resin has a weight average molecular weight of from 500-100000.

7. The liquid developer according to claim 1, wherein the insulating liquid mainly contains a vegetable oil.

* * * * *